US005931603A

United States Patent [19]

Swain et al.

[11] Patent Number: 5,931,603

[45] **Date of Patent: *Aug. 3, 1999**

[54] METHOD FOR CONTROLLING MOISTURE INSIDE A FOUNDATION

[76] Inventors: Kenneth L. Swain, 701 Park Ave., Greenwood, Ind. 46143; Greg B. Key, 5106 Shelby St., Indianapolis, Ind. 46227

[ * ] Notice: This patent is subject to a terminal disclaimer.

[21] Appl. No.: 08/885,717

[22] Filed: Jun. 30, 1997

Related U.S. Application Data

[63] Continuation-in-part of application No. 08/528,346, Sep. 14, 1995, Pat. No. 5,642,967.

[51] Int. Cl.[6] ..... F02B 11/00

[52] U.S. Cl. ..... 405/229; 52/169.5

[58] Field of Search ..... 405/229; 52/169.5, 52/302.1, 302.3

[56] References Cited

U.S. PATENT DOCUMENTS

| | | | |
|---|---|---|---|
| 3,426,487 | 2/1969 | Forte | 52/1 |
| 3,562,982 | 2/1971 | Parezo | 52/169 |
| 3,852,925 | 12/1974 | Gazzo | 52/169 |
| 3,990,469 | 11/1976 | Ralston | 137/362 |
| 4,253,285 | 3/1981 | Enright | 52/169 |
| 4,486,986 | 12/1984 | Cosenza | 52/169 |
| 4,523,875 | 6/1985 | DiFiore | 405/50 |
| 4,612,742 | 9/1986 | Bevilacqua | 52/169 |
| 4,869,032 | 9/1989 | Geske | 52/169 |
| 5,248,225 | 9/1993 | Rose | 405/229 |
| 5,642,967 | 7/1997 | Swain et al. | 405/229 |

*Primary Examiner*—William Neuder

*Attorney, Agent, or Firm*—Woodard, Emhardt, Naughton, Moriarity & McNett

[57] ABSTRACT

Method of reducing moisture damage to a building having a foundation, such as crawl space or a basement, with a floor that includes excavating a pit in the floor and positioning a plastic liner in the pit. This plastic liner defines a cavity and an inlet intersecting the cavity that is configured to collect water. A space exists between the liner and the pit. A trench is formed in a portion of the floor and configured to intersect the pit. A drain tile is put in the trench that has an outlet engaging the inlet of the liner. A pneumatic conveyor system is positioned outside the crawl space or basement that has an intake and a dispensing outlet. An aggregate source is provided outside the foundation adjacent the intake, and the aggregate generally does not exceed the size of pea gravel. A flexible hose is connected to the dispensing outlet which has a discharge outlet selectively positioned within the crawl space or basement. Aggregate is placed into the intake and then discharged through the discharge outlet by pressurized air at a rate of at least two tons per hour. Aggregate is deposited on the floor of the crawl space or basement, which may also include the trench and space surrounding the liner. A moisture barrier is optionally placed on top of the floor and aggregate, and at least a portion of the foundation wall to reduce exposure of the building to moisture from the foundation. A pump system is installed for pumping water out of the pit.

20 Claims, 2 Drawing Sheets

METHOD FOR CONTROLLING MOISTURE INSIDE A FOUNDATION

This is a continuation-in-part of our prior application Ser. No. 08/528,346, filed Sep. 14, 1995, which will issue Jul. 1, 1997 as U.S. Pat. No. 5,642,967.

This invention relates to methods and systems for reducing moisture damage to a building that has a foundation with a crawl space or a basement.

BACKGROUND OF THE INVENTION

Many buildings have a foundation in the form of a crawl space or a basement. And in most cases the majority of the foundation is underground with a soil, gravel, or concrete floor. But unfortunately, the floor is also often lower than adjacent ground water. This can cause water to seep through the foundation and into the building. This water may encourage microorganisms to grow in the building and may also erode the foundation.

Some builders attempt to solve this problem by installing a moisture barrier, such as plastic, over the floor of the foundation. Although this barrier can reduce the building's exposure to minor amounts of water that is present below the barrier, it does nothing to remove water from a truly wet foundation. In fact, the barrier may actually hold water and prevent it from draining.

One way to solve this problem is to install drain tile in the floor. This approach requires a sump pit and a trench along the inner perimeter of the foundation to hold the tile. The trench and commonly the pit's perimeter are then both filled with aggregate. The drain tiles then collect water from the floor as it seeps through the foundation and guide it into the pit. The system may also include a pump to remove the water from the pit when it exceeds a predetermined level.

A similar system is shown in U.S. Pat. No. 3,562,982 to Parezo which is hereby incorporated into this specification by reference. Notably, this system does not remove all the water that is present in the crawl space, nor does it eliminate the need for a moisture barrier. Instead, this system simply removes excess water in the crawl space and keeps it under the barrier so that the remainder of the building is not exposed.

While this system is effective, it is also costly to install once the building has been built. For example, one costly aspect is the movement of the aggregate into the crawl space or basement and the laborious task of placing it in position. The gravel is first slid down shoots and then moved by hand to the desired location with a shovel or a sled.

Moreover, a less complex drain system without drain tiles or a trench might be used in some situations where the moisture problem is not so severe. But unfortunately, these alternatives also require additional aggregate. Hence, these alternative systems are not used because they are not cost-effective. The labor-intensive and generally expensive methods that are currently used to place the aggregate quickly offset any savings that the alternative methods may otherwise offer.

What is needed is a way to reduce the cost of installing drain-tile systems as well as a way to make any alternative system that uses aggregate more cost effective. And this invention addresses that need.

SUMMARY OF THE INVENTION

One aspect this invention is the pneumatic transport of aggregate to use in the correction of moisture problems in a foundation. One preferred embodiment that implements this feature includes creating a pit in the floor of the foundation for collecting water and pneumatically moving an aggregate through a conduit to a selected position within the crawl space or basement of the foundation. An aggregate bed is established on the floor using at least a portion of the aggregate that was pneumatically moved into the foundation. The aggregate bed is configured to drain water into the pit for collection. This configuration may include a trench, or a trench containing drain tile. A moisture barrier then optionally is positioned over the aggregate bed and floor to reduce exposure of the building to moisture from the basement or crawl space. Generally, this system keeps excess moisture under the barrier.

Another aspect this invention is the ability to cost effectively respond to the severity of the moisture problem by selecting the most appropriate moisture control system. In light to moderate cases, an aggregate bed over the surface area of the floor and a sump pit system is adequate. One method of addressing more severe moisture problems is the addition of a trench in a portion of the foundation floor that is configured to intersect the pit. This trench enhances collection and drainage of water to the pit. Aggregate is pneumatically deposited into the trench to displace excess water and guide it into the pit. In more severe cases a drain tile is positioned within the trench to further enhance collection and drainage of water. In the most severe cases, an aggregate bed is arranged over the entire surface area of the floor in addition to using a trench with drain tile. Optionally, one may also position a moisture or vapor barrier on top of the aggregate to reduce exposure of the building to moisture from the foundation regardless of the configuration selected.

Accordingly, one object of the present invention is to provide an improved method of moving aggregate to desired locations for use in a moisture control system for a foundation, such as a crawl space or a basement.

Another object of the present invention is to provide a foundation moisture control system that does not require formation of a trench.

Still another object of the present invention is to provide a foundation drainage system which does not require drain tiles.

Further objects, features, and advantages of the present invention shall become apparent from the detailed drawings and descriptions that follow.

DESCRIPTION OF THE PREFERRED EMBODIMENT

We use specific language in the following description to publicly disclose our invention and to convey its principles to others. No limits on the breadth of our patent rights based simply on using specific language are intended. We also include in our rights any alterations and modifications to our description that should normally occur to one of average skill in this technology.

This invention relates to a system and a method to control moisture in a foundation. One aspect of the invention is to use a pneumatic conveyor to move aggregate from a source outside the foundation to a location inside the foundation. Another aspect of the invention is to cost effectively respond to the severity of the moisture problem by selecting the most appropriate moisture control system. This selection can account for variables such as the relationship of the foundation to the water table, soil conditions, geometry of the foundation, geometry and composition of the ground surrounding the foundation, and the relative cost of equipment and labor.

When an evaluation indicates a severe moisture problem, a drain tile system is generally required. In the most severe cases, a layer of aggregate is added to cover the entire floor of the foundation in addition to the installation of a trench with drain tiles. When a problem of intermediate severity is detected, a trench system without drain tile is generally indicated. Similarly, in one variation of this system, a layer or bed of aggregate not only occupies the trench, but also covers a large portion of the surface area of the foundation floor. When the problem is of a light to moderate concern, then an aggregate bed without a trench or drain tile often suffices. Naturally, many variations of these systems exist as would occur to those skilled in the art, given the factors associated with a particular crawl space or basement. For all these systems, certain common preparations may be involved. One typical arrangement is depicted in FIG. 1.

Figure 1:
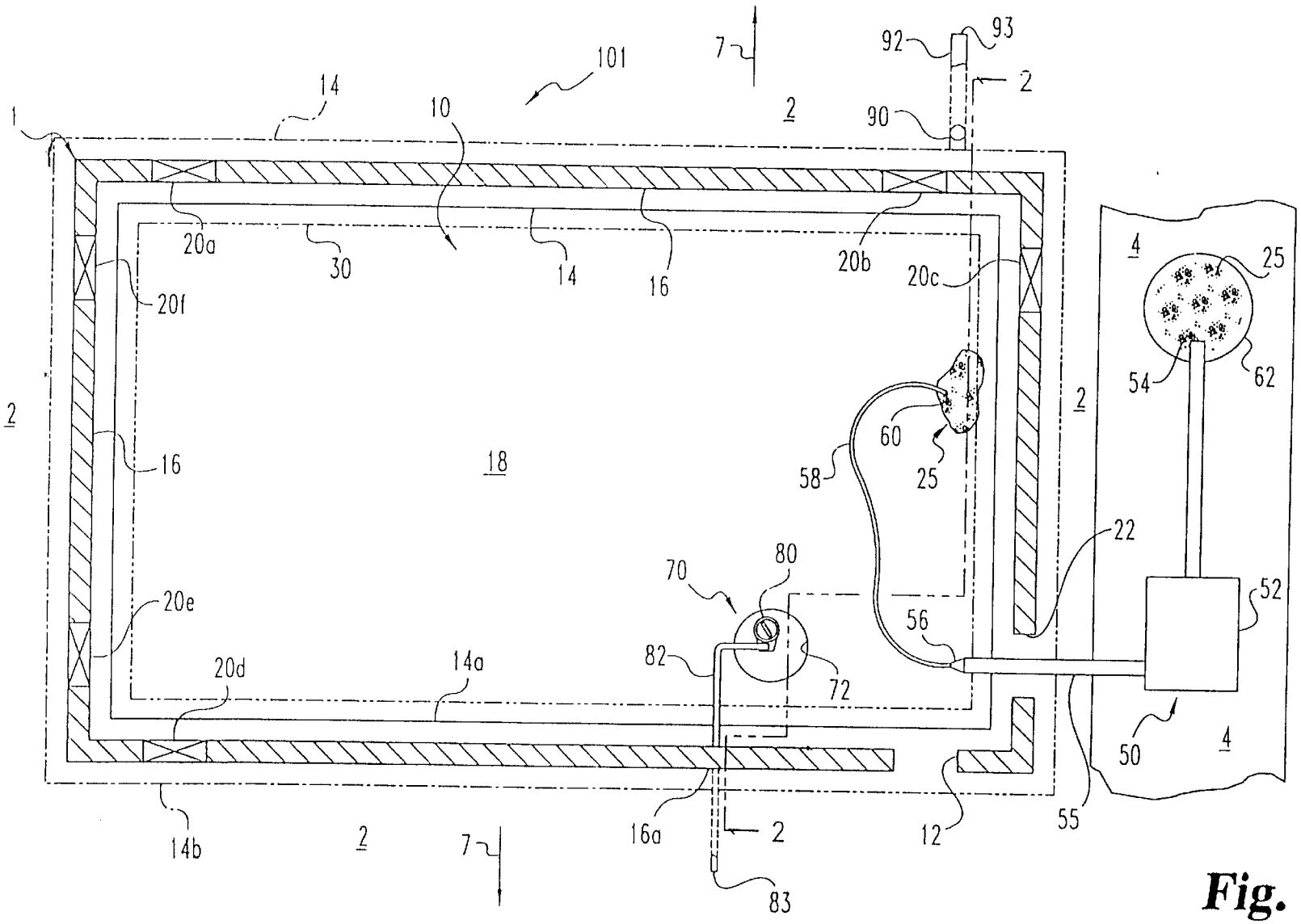
FIG. 1 is a schematic sectional top view of a building taken just above ground level with a pneumatic conveyor installed in the crawl space or basement of the building in accordance with one preferred embodiment of the present invention. Various surroundings of the building are schematically depicted.

FIG. 1 shows foundation 1 of a building 101 surrounded by ground surface 2 and adjacent driveway 4. Ground surface 2 is configured with a negative slope along a direction away from foundation 1 as indicated by arrows 7 so that water generally flows away from the building 101 and foundation 1. Foundation 1 includes footer 14 and perimeter walls 16. Typically, footer 14 is poured concrete and walls 16 comprise concrete block, but other configurations well known to those skilled in the art are also contemplated. The inner margin 14*a* of footer 14 is shown by a solid line within crawl space or basement 10 indicating that it may be visible. In other preferred embodiments, footer 14 may be covered by dirt, concrete, or other material inside crawl space or basement 10. The corresponding outer margin 14*b* of footer 14 is shown in a broken line to indicate its underground position for the embodiment shown in FIG. 1.

Foundation 1 encloses and defines a crawl space or basement 10 that has a floor 18 and access opening 12. Walls 16 define vents 20*a*–20*f*. Wall portion 16*a* defines a passage for pipe 82 connected within crawl space or basement 10 to pit system 70. Pit system 70 includes a pit 72 and sump pump 80 within crawl space or basement 10. Also, passage 22 is illustrated where a vent has been removed to provide for access by a portion of pneumatic conveyor system 50.

The foundation moisture control system of the present invention includes the placement of aggregate 25 within crawl space or basement 10. In the preferred embodiment, aggregate 25 generally includes at least some particles larger than sand. In a more preferred embodiment, the majority of aggregate 25 by weight consists of particles sized at least as large as pea sized gravel. In the most preferred embodiment, aggregate 25 is generally pea-sized gravel.

Pneumatic conveyor system 50 is for moving aggregate 25 from aggregate source 62 located outside foundation 1 to within crawl space or basement 10. System 50 includes pneumatic conveyor 52 with an intake 54 configured to receive aggregate 25 from aggregate source 62, and dispensing tube 55 with dispensing outlet 56 configured to dispense aggregate 25 received through intake 54. In the preferred embodiment shown, dispensing outlet 56 is in fluid communication with discharge conduit 58. Discharge conduit 58 has discharge outlet 60 for dispensing aggregate within crawl space or basement 10. Preferably, discharge conduit 58 is a flexible hose with a diameter of approximately 3 inches.

In one preferred embodiment, pneumatic conveyor 52 is powered by a diesel engine, and the pneumatic conveyor system 50 is mobile. For example, pneumatic conveyor system 50 is mounted to an over-the-road trailer that can be readily transported to a selected site having a moisture control problem and parked in an adjacent street or driveway. One preferred source of pneumatic conveyor 52 is the VACUTRANS system. Generally, the delivery rate of this system depends on the selected air pressure, the length and configuration of the discharge conduit, and the aggregate size. With a discharge conduit 58 of about 150 feet in length, the VACUTRANS system is capable of transferring at least 2 tons of pea size gravel per hour into crawl space or basement 10.

FIG. 1 includes a trench line 30 in phantom along the inner perimeter of foundation 1 to indicate where a trench is preferably formed in floor 18 to facilitate implementation of some preferred embodiments of the present invention. For foundations having an internal wall within the crawl space or basement, it may be advisable to excavate the trench under such wall or to create a passageway for the trench through the wall. Similarly, some unusually configured footers or foundation floors including a concrete slab may require reconfiguration of a portion of such structure as part of the moisture control process. These adjustments are assessed on a case-by-case basis and also depend on the severity of the moisture problem.

Figure 2:
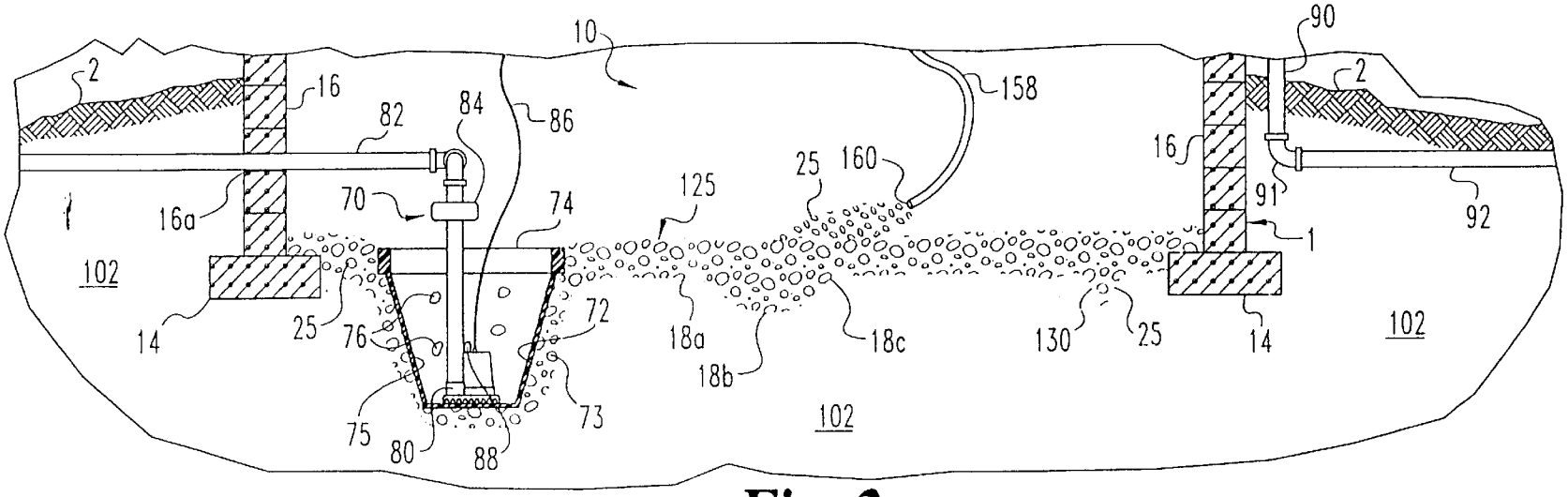
FIG. 2 is a schematic side view of a section taken of FIG. 1 illustrating installation of one preferred embodiment of the foundation moisture control system with the pneumatic conveyor shown in a different position than in FIG. 1.

Referring to FIG. 2, as well as FIG. 1, pit system 70 includes a pit 72 which preferably is formed or excavated in a low lying portion of floor 18 near entrance 12 for ease of servicing. Also, pit system 70 includes a pump system with a sump pump 80 connected to conduit or pipe 82. Pipe 82 gradually emerges from underground portion 102 and eventually terminates at outlet 83 because of the negative grade of ground surface 2 as indicated by arrows 7. Pipe 82 includes a check valve 84 to prevent backflow of water into pit 72 through pipe 82. In other preferred configurations, pipe 82 may terminate underground in a dry well or sewer system.

In still another preferred embodiment, pipe 82 terminates in a bubbler system, which is used when no negative slope exists, or when the slope is very gradual. The bubbler system is positioned underground in a location remote to foundation 1. In this system, outlet 83 of pipe 82 intersects a T-shaped junction pipe in fluid communication therewith and having a lower limb directed generally downward into a well that is about 2–3 feet deep and about 8–10 inches in diameter. This well is filled with aggregate. Preferably, this lower limb is a 4 inch perforated tile that extends down into the hole and is also filled with aggregate. The T-shaped junction pipe also has an upper limb generally opposite the lower limb, which terminates in a grate on the ground surface. This grate allows for overflow of water when the aggregate filled well cannot accommodate all the drainage. Essentially, this bubbler system is a small dry well that can accept 5–7 gallons of water for absorption by the ground in a fairly dry time, or in times of high water, can release excess water through the surface grate.

Pit 72 includes liner 74 that defines a cavity 75 therein. Liner 74 is generally configured in a bucket or barrel shape and is sized so that a space 73 is defined between pit 72 and the side of liner 74. In the preferred embodiment shown, pit 72 and liner 74 are configured so that space 73 extends between the bottom of pit 72 and the underside of liner 74. Aggregate 25 is shown filling space 73. Liner 74 is perforated with a plurality of holes 76 to facilitate drainage of excess water from surrounding aggregate 25. In one preferred embodiment, as many as 200 perforations are made, and liner 74 is made of a plastic material. In another preferred embodiment, pit system 70 does not include a liner. In still another preferred embodiment, the pit system 70 does not include a sump pump. Instead, for example, the pump system may use a pump external to pit 72 to remove excess water. In a variation of this embodiment, no pump system is used at all and pit 72 is configured to accept the excess water for absorption by the ground like a dry well.

The sump pump 80 of pit system 70 preferably has bladder switch 88 which is used to trigger activation of sump pump 80 when water within pit 72 exceeds a predetermined level. Also, for the preferred embodiment shown, power line 86 supplies electricity to an electric motor which drives sump pump 80.

Also depicted in FIGS. 1 and 2 is downspout 90, which is used, for example, to drain rainwater from a gutter system (not shown). Downspout 90 is connected in fluid communication with conduit 92 by elbow 91. Notably, this connection occurs in the surrounding underground portion 102. Because of the negative grade of ground surface 2 as indicated by arrows 7, conduit 92 emerges from underground portion 102 and terminates at outlet 93. This arrangement directs water from downspout 90 away from the building and out outlet 93 to reduce accumulation of water around foundation 1 or in crawl space or basement 10.

In one preferred embodiment, vents 20*a*–20*f* are modified or replaced as part of the moisture problem corrective action. Preferably, when replacement is required, temperature controlled vents are used which begin to open at approximately 40° Fahrenheit and become fully open at about 70° Fahrenheit. Correspondingly, these vents gradually close as the temperature cools. In one preferred embodiment, temperature controlled vents are positioned about 4 feet from the comers of the building to maximize moisture removal by cross ventilation.

FIG. 2 illustrates one preferred embodiment that employs trench 130 along trench line 30. Trench 130 is configured to intersect pit 72. This configuration is designed to correct a foundation moisture problem of intermediate severity. As such, drain tiles are not required within trench 130. Instead, in this embodiment, aggregate 25 is dispensed through discharge outlet 160 and is arranged in a generally uniform aggregate bed 125 over floor 18. Aggregate bed 125 also occupies trench 130. Aggregate bed 125 also includes aggregate 25 surrounding liner 74 in pit 72. Preferably, bed 125 is leveled so that high points in the floor such as 18*a* and low points 18*b* are uniformly covered to provide an even surface on top of aggregate bed 125. Aggregate bed 125 provides a way to displace excess water contained in the foundation to trench 130 and into pit 72. In one preferred embodiment, the average thickness of aggregate bed 125 along floor 18 is about 2 to 3 inches exclusive of that portion of the aggregate bed occupying trench 130 and pit 72.

In the preferred embodiment shown, trench 130 is formed with a V-shaped cross-section. Preferably this V-shaped trench has a depth of about 6 to 7 inches and a width at the level of floor 18 of about 3 to 4 inches. Notably, the excavation required to form a V-trench of these dimensions is somewhat less laborious than the usual drain tile trench. However, other preferred embodiments may vary the trench shape as would occur to one skilled in the art. In one preferred embodiment, an expanded nylon geotextile fabric insert is used in trench 130.

Figure 3:
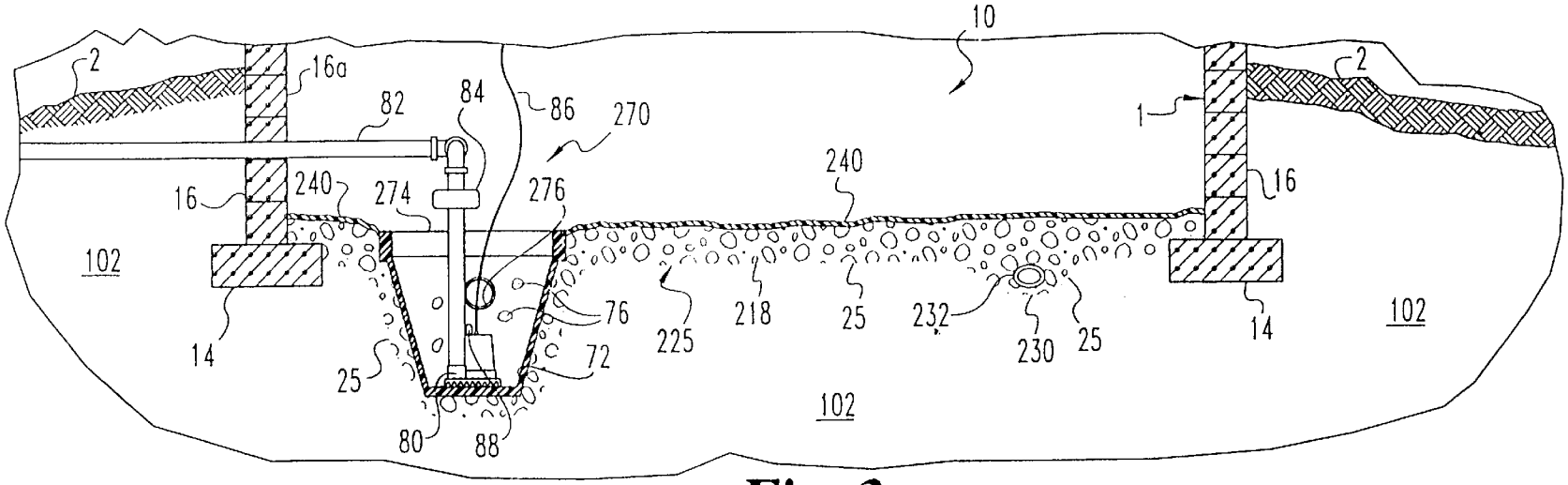
FIG. 3 is a schematic side sectional view of a foundation similar to FIG. 2 illustrating an alternative preferred embodiment of the present invention.

Once all the aggregate 25 is dispensed and arranged to form aggregate bed 125 for the "tileless" trench system shown in FIG. 2, a vapor barrier is installed on top of aggregate bed 125 like vapor barrier 240 illustrated for another preferred embodiment of the foundation moisture control system shown in FIG. 3. Preferably barrier 240 is a heavy gauge flexible plastic sheet. And when used in a basement, it may be preferable to extend this vapor barrier up at least a part of the inside of the foundation. This procedure is well-known and may complemented by drilling holes in the foundation to allow water to flow through the wall, under one side of the vapor barrier, and into the trench. The vapor barrier and trench are then usually hidden behind a false, interior wall for aesthetic purposes.

Referring specifically to FIG. 3, an alternative embodiment of the present invention is illustrated for a most severe foundation moisture control problem. In this preferred embodiment, pit system 270 is arranged the same as pit system 70 shown in FIGS. 1 and 2 with like structure being identically numbered. Notably, liner 274 of pit system 270 includes an inlet 276 configured for engagement of drain tiles 232. Preferably, these drain tiles are about 4 inches in diameter. Drain tiles 232 provide for more rapid drainage of excess water to pit system 270 and generally permit a greater quantity of water to be removed from crawl space or basement 10 compared to the "tileless" system illustrated in FIG. 2.

Drain tiles 232 are positioned along trench 230 and empty into pit system 270 through inlet 276. In one preferred embodiment, trench 230 is formed along trench line 30 (see in FIG. 1.), and is about 8 to 10 inches deep and about 1 foot wide at the top. In this embodiment, drain tiles 232 are positioned about 2 to 3 inches below the top of footer 14. This depth provides adequate drainage and yet does not incur the added expense of placing the tile deeper. Generally, the water table within the foundation follows the depth of the drain tile in the trench. Notably, if the drain tile is lower than necessary, water is pumped at a higher rate generating more expense and more wear on the system.

The system shown in FIG. 3 includes an additional bed of aggregate 225 that extends across floor 218 to improve drainage. Aggregate bed 225 also occupies trench 230 and surrounds liner 274 in pit 72. Aggregate bed 225 displaces excess water and drains it into trench 230, drain tiles 232, and ultimately into pit system 270. In one preferred embodiment, the average thickness of the aggregate bed 225 along the floor is about 1 inch exclusive of that portion of aggregate bed 225 occupying trench 230 and pit 72. Preferably, aggregate bed 225 is arranged to provide a generally even surface for coverage by vapor barrier 240.

In another preferred embodiment of the present invention for correcting foundation moisture control problems of light to moderate severity, a pit system like that shown in FIG. 2 is employed, but no trench is formed nor drain tiles installed. Instead, this preferred embodiment employs an aggregate bed that covers the floor to drain excess water to the pit system for removal. The thickness of this bed averages about 2 to 5 inches. In one preferred variation of this embodiment, the bed is arranged so that the floor has a generally level top surface for coverage by a moisture barrier.

Having described various preferred embodiments of the present invention, the operation of the associated moisture control processes is next discussed. One preferred method of controlling moisture in a crawl space or basement in accordance with the present invention begins by evaluating the severity of the moisture control problem. This step requires inspection of the crawl space or basement to determine its condition and accounts for all relevant factors and variables. One outcome of this evaluation is determining a target configuration for the moisture control system to be installed. Generally, any of the previously described systems could be used or any combination of the various elements disclosed as would occur to one skilled in the art. Next, the installation of the moisture control system is initiated.

Referring back to FIG. 1, the installation process may include removal of trash and debris from crawl space or basement 10 and the repair of any damaged building structure. Also, if the structure requires reconfiguration, then such modifications may be performed. If it is determined that a trench is required, as might be the case for an intermediate to severe problem, it should be formed along an appropriate path. Often, electric shovels or hammers are used to perform reconfiguration and excavation steps. Similarly, if it is determined drain tiles are required, as might be the case for a severe problem, then they should be installed. Generally, a pit system 70 will be installed with an appropriate pump system. Also, aggregate 25 will need to be employed within crawl space or basement 10. Preferably, moving and dispensing aggregate 25 is accomplished with pneumatic conveyor system 50.

When pneumatic conveyor system 50 is used, it must be positioned along with aggregate source 62 in an appropriate location outside crawl space or basement 10. This placement may involve removal of a vent or other structure to provide for passage of pneumatic conveyor system 50 into crawl space or basement 10 to facilitate movement and dispensing of aggregate 25, but removal of all the vents 20*a*–20*f* is not required. Intake 54 of pneumatic conveyor system 50 draws aggregate 25 from aggregate source 62 by suction. This aggregate is then conveyed through pneumatic conveyor 52. The aggregate is then propelled through dispensing outlet 56 into discharge conduit 58 and out discharge outlet 60 by pressurized air for selected placement within crawl space or basement 10.

In one preferred embodiment, aggregate source 62 is a gravel pile supplied adjacent pneumatic conveyor 52. In an alternative preferred embodiment, the gravel is supplied in a hopper configured for access by intake 54 of pneumatic conveyor 52. In another preferred embodiment, the aggregate hopper is affixed to pneumatic conveyor 52 so that gravel is carried along with the conveyor 52 and the aggregate is fed by gravity into the conveyor device.

Aggregate 25, once located within crawl space or basement 10 is then arranged as required for the specific moisture control system desired. This arrangement may include establishing an aggregate bed such as bed 125, 225 shown in FIGS. 2 and 3, respectively, or any variation as would occur to one skilled in the art. This bed may be deposited in a trench, around a drain tile, or surround a pit system liner as appropriate. The aggregate bed is arranged or configured to facilitate drainage of excess water in the crawl space or basement to the pit system 70 including water surrounding crawl space or basement 10 and water that seeps through walls 16 and around footer 14.

Preferably, a moisture barrier is installed over the floor and aggregate to prevent exposure of the building. Moisture is kept beneath the barrier by displacing water through the porous aggregate bed for collection in pit system 70. As the water level rises in pit system 70, the pump 80 is activated so that water is controllably pumped through pipe 82 away from the building and foundation 1.

While we have attempted to illustrate and describe our invention in detail, please consider this as illustrative and not restrictive of our patent rights. The reader should understand that we have only presented our preferred embodiments and that all changes and modifications that come within the spirit of our invention are included if the following claims or the legal equivalent of these claims describes them.

We claim:

1. A method of reducing moisture damage to a building having a foundation with an interior perimeter and a floor, comprising the steps of:

(a) forming a pit in the floor for collecting water;

(b) pneumatically moving an aggregate to a selected position inside the perimeter;

(c) establishing an aggregate bed on at least a part of the floor using at least a portion of the aggregate moved in step (b); and (d) configuring the aggregate bed to drain water into the pit for collection.

2. The method of claim 1, and further comprising the step of positioning a moisture barrier over at least a portion of the aggregate bed.

3. The method of claim 1, and further comprising the steps of positioning a liner in the pit, the liner being configured to define a cavity for collecting water, the liner being sized to define a space between the liner and the pit; and depositing aggregate into the space.

4. The method of claim 3, and further comprising the step of installing a pump system for pumping water out of the cavity when water in the cavity exceeds a predetermined level.

5. The method of claim 1 where the aggregate is moved in step (b) at a rate of at least two tons per hour.

6. The method of claim 1 where a majority by weight of the aggregate moved in step (b) is at least the size of pea gravel.

7. The method of claim 1, and further comprising the steps of excavating a trench in a portion of the floor that intersects the pit and arranging the aggregate bed to occupy at least a portion of the trench.

8. The method of claim 7, and further comprising the step of placing drain tile in at least a portion of the trench to facilitate drainage into the pit.

9. The method of claim 7, where a majority by weight of the aggregate moved in step (b) is at least the size of pea gravel and further comprising the step of arranging the aggregate bed to fill the trench.

10. The method of claim 9, where the aggregate bed covers substantially all of the floor with an average thickness of at least 1 inch.

11. The method of claim 1, where step (b) includes the steps of:

(b)(1) positioning a pneumatic conveyor system outside the foundation, the conveyor system having an intake to receive material and a conduit defining a discharge outlet for dispensing received material;

(b)(2) providing an aggregate source outside the foundation adjacent the intake; and (b)(3) selectively positioning the discharge outlet within said perimeter in a desired location.

12. The method of claim 11, where step (b) further includes the steps of:

(b)(4) placing aggregate into the intake from the aggregate source; and (b)(5) discharging the aggregate through the conduit and out the discharge outlet at the desired location.

13. A method of reducing moisture damage to a building having a foundation with a floor, comprising the steps of:

(a) forming a pit in the floor for collecting water;

(b) forming a trench in a portion of the floor that intersects the pit;

(c) pneumatically depositing an aggregate in the trench; said depositing including:

(c)(1) positioning a pneumatic conveyor system outside the foundation, the conveyor system having an intake to receive material and a conduit defining a discharge outlet for dispensing received material;

(c)(2) providing an aggregate source outside the foundation adjacent the intake; and (c)(3) selectively positioning the discharge outlet adjacent the trench.

14. The method of claim 13, including the step of placing a plastic film on top of at least a portion of the aggregate or the foundation.

15. The method of claim 13, where step (c) further includes the steps of:

(c)(4) placing aggregate into the intake from the aggregate source; and (c)(5) discharging the aggregate through the discharge outlet and into the trench.

16. The method of claim 13, and further comprising the step of placing drain tile in at least a portion of the trench to facilitate drainage into the pit.

17. The method of claim 13, where a majority by weight of the aggregate moved in step (c) is at least the size of pea gravel, and further comprising the step of arranging the aggregate bed to fill the trench.

18. The method of claim 13, and further comprising the steps of:

(d) positioning a liner in the pit, the liner defining a cavity for collecting water, the liner being sized to define a space between the liner and the pit;

(e) depositing aggregate into the space;

(f) installing a pump system for pumping water out of the cavity when water in the cavity exceeds a predetermined level.

19. The method of claim 13, where the aggregate is deposited in step (c) at a rate of at least two tons per hour.

20. A method of reducing moisture damage to a building having a basement with a floor, comprising the steps of:

(a) excavating a pit in the floor;

(b) forming a trench in at least a portion of the floor, the trench being configured to intersect the pit;

(c) positioning a pneumatic conveyor system outside the basement, the conveyor system having an intake to receive material and a discharge outlet for dispensing received material;

(d) providing an aggregate source outside the basement;

(e) selectively positioning the discharge outlet within the basement;

(f) placing aggregate into the intake from the aggregate source;

(g) discharging the aggregate through the discharge outlet; and (h) depositing aggregate into the trench.

* * * * *